US012379193B2

(12) United States Patent
Sadler

(10) Patent No.: US 12,379,193 B2
(45) Date of Patent: Aug. 5, 2025

(54) TANDEM CHARGE FOR UNDERWATER TARGETS

(71) Applicant: Raytheon Company, Arlington, VA (US)

(72) Inventor: Coulton T. Sadler, Tucson, AZ (US)

(73) Assignee: Raytheon Company, Arlington, VA (US)

( * ) Notice: Subject to any disclaimer, the term of this patent is extended or adjusted under 35 U.S.C. 154(b) by 2 days.

(21) Appl. No.: 18/498,587

(22) Filed: Oct. 31, 2023

(65) Prior Publication Data

US 2025/0137763 A1 May 1, 2025

(51) Int. Cl.

| | |
|---|---|
| ***F42B 12/16*** | (2006.01) |
| ***F42B 1/028*** | (2006.01) |
| ***F42B 12/18*** | (2006.01) |
| ***F42B 19/00*** | (2006.01) |

(52) U.S. Cl.

CPC ..... *F42B 12/18* (2013.01); *F42B 1/028* (2013.01); *F42B 12/16* (2013.01); *F42B 19/00* (2013.01)

(58) Field of Classification Search

CPC ..... F42B 1/028; F42B 12/10; F42B 12/16; F42B 12/18; F42B 12/625; F42B 17/00; F42B 19/00

USPC ..... 102/306, 308, 310, 476

See application file for complete search history.

(56) References Cited

U.S. PATENT DOCUMENTS

| | | | | |
|---|---|---|---|---|
| 4,063,512 | A | 12/1977 | Davis | |
| 7,363,862 | B2 * | 4/2008 | Gilliam | F42B 12/16 102/491 |
| 7,493,861 | B1 * | 2/2009 | Walters | F42B 12/18 102/308 |
| 7,987,789 | B2 * | 8/2011 | Regebro | F42B 12/204 102/478 |
| 9,476,682 | B1 * | 10/2016 | Powell | F42B 12/12 |
| 11,486,233 | B2 | 11/2022 | Sadler et al. | |
| 11,821,715 | B2 * | 11/2023 | Huecking | F42B 19/00 |
| 2003/0177933 | A1 * | 9/2003 | Fortner | F42B 12/16 102/476 |

OTHER PUBLICATIONS

Hu, Zhecheng, et al., "Formation and Penetration Capability of an Annular-Shaped Charge", Mathematical Problems in Engineering, vol. 2021, Article ID 6660189, (Apr. 20, 2021), 14 pgs.

* cited by examiner

*Primary Examiner* — James S Bergin

(74) *Attorney, Agent, or Firm* — Schwegman Lundberg & Woessner, P.A.

(57) ABSTRACT

A tandem charge for prosecution of underwater targets includes both a precursor charge (PC) and a follow through charge (FTC) oriented within and along an axis of a charge casing with the FTC positioned in front of the precursor charge. The precursor charge includes an explosive charge and a liner configured such that upon detonation of the explosive charge the liner forms an annular explosively formed penetrator (EFP) that is projected along the axis and passes around the FTC to cut a first hole in an outer surface of the target. The FTC is configured to be carried through the first hole in the outer surface of the target by the flow of water therethrough for detonation on the other side of the outer surface of the target, perhaps forming a second hole in an inner surface of the target.

20 Claims, 13 Drawing Sheets

TANDEM CHARGE FOR UNDERWATER TARGETS

BACKGROUND

Field

This disclosure relates to explosive charges for underwater targets, and more particular to a tandem charge configuration to form larger holes inside those underwater targets. The tandem charge may, for example, be used to penetrate double-hulled ships and submarines or in commercial applications such as fracking to remove oil from the ground.

Description of the Related Art

Shape-forming charges are explosive charges shaped to focus the effect of the explosive's energy in specific direction and are purely kinetic in nature. A shape-forming charge is composed of two major components: an explosive charge and a metal liner on a forward surface of the explosive charge. The angle formed by the metal liner is referred to as the "apex angle". Shape-forming charges may be used to penetrator armor, punch holes in naval vessels such as surface ships or submarines or to perforate wells in the oil and gas industry.

One type of shape-forming charge is referred to as an explosively formed penetrator (EFP). Detonation of the explosive charge causes the metal liner to fold, forward or backward, into a single coherent penetrator that is accelerated to extremely high velocities. Formation of the penetrator is approximately 100% mass efficient (at least 90%). The apex angle is typically 150°-170°. The EFP can be configured to form the single coherent penetrator as a slug or as an annular ring. The annular ring may have a larger diameter than the slug and thus cut a larger hole in the target but will have less penetration depth.

Another type of shape-forming charge is referred to as a shaped charge. The shaped charge liner has an apex angle of typically 60° or less. Upon detonation, the liner material collapses toward the centerline and is projected forward as both a slug and a metal jet. The slug makes up approximately 75% of the liner mass and has minimal penetration. The slug travels slower than the EFP but the metal jet tip travels much faster (approximately 3×) and thus has much greater penetration capabilities than the EFP. The tradeoff is that the metal jet has a much smaller diameter than either the EFP slug or annular ring and a lesser stand-off distance than either.

To prosecute hardened targets such as tanks, armored personnel carriers or bunkers, a missile/rocket/guided munition may be provided with a tandem charge. A shaped charge is positioned in front of a penetrator or blast warhead. The shaped charge forms the axial metal jet to punch a small hole in the hardened target. The penetrator/blast warhead have sufficient kinetic energy provided by the missile/rocket/guided munition to follow the axial metal jet to penetrate and destroy the hardened target. Without the lead hole formed by the jet, neither the penetrator nor blast warhead could sufficiently penetrate the hardened target to destroy the target.

To prosecute underwater targets such as a surface ship hull or a submarine, the shape-forming charge may have to penetrate a single or double hull and target a critical system with double-hulls being the norm. A shaped charge that forms a high velocity axial metal jet will punch a very small hole, one having a diameter approximately 10% of the diameter of the shaped charge itself, through both hulls with sufficient residual velocity to degrade the critical system assuming proper targeting. However, the small size of the hole is readily plugged and will not produce a flow rate of water inside the hull sufficient to disrupt operations. The effectiveness of the shaped charge is dependent on the proper aiming of the jet to impact critical systems within the target. This represents the current state-of-the-art in torpedo ("self-propelled underwater vehicle") design.

Another approach is a tandem shape-forming charge in which an on-axis shaped charge is configured to form a very high velocity axial metal jet and an annular explosive charge and liner are configured to form a high velocity annular EFP. The axial metal jet penetrates and forms a hole in both the outer and inner hulls with sufficient residual velocity to target an on-board system. The annular EFP penetrates and forms a larger hole in the outer hull only. The larger hole may be between 100% and 140% of the diameter of the annular charge. The hole formed in the inner hull by the axial metal jet is about 10% of the diameter of the annular charge.

SUMMARY

The following is a summary that provides a basic understanding of some aspects of the disclosure. This summary is not intended to identify key or critical elements of the disclosure or to delineate the scope of the disclosure. Its sole purpose is to present some concepts of the disclosure in a simplified form as a prelude to the more detailed description and the defining claims that are presented later.

The present disclosure provides a tandem charge for prosecution of underwater targets such as double-hulled sea going vessels including surface ships and submarines or in fracking operations to remove oil and gas from the Earth. The tandem charge may be specifically configured to open larger holes in the inner surface of the target than a standard shape-charge jet to increase the flow rate of water through those holes to for example, disrupt operations within the double-hulled vessel or to better remove oil or gas from the ground. Alternately, the tandem charge may be configured to disrupt operations on the other side of the outer surface of the target.

In an embodiment, a tandem charge includes both a precursor charge (PC) and a follow through charge (FTC) oriented within and along an axis of a charge casing with the FTC positioned in front of the precursor charge. The precursor charge includes an explosive charge and a liner configured such that upon detonation of the first explosive material the liner forms an annular explosively formed penetrator (EFP) that is projected along the axis and passes around the FTC to cut a first hole in an outer surface of the target. The FTC is configured to pass through the first hole in the outer surface of the target for detonation on the other side of the outer surface of the target. The flow of water carries the FTC through the first hole in the outer surface without the need for additional propulsion. In an embodiment, detonation of the FTC forms a second hole in an inner surface of the target e.g., the inner hull of a surface vessel or submarine. The diameter of the second hole being at least 30% of the diameter of the undetonated precursor charge.

In an embodiment, the FTC may be a blast charge that upon detonation expands both longitudinally along the axis and radially from the axis. The blast charge may or may not be a fragmentation charge. This may be referred to as an "omnidirectional" detonation. Omnidirectional detonation has the advantage of not requiring the FTC to maintain a precise orientation with respect to the inner surface of the target. The blast charge should open a second hole in the inner surface that is approximately 40-60% of the diameter of the undetonated precursor charger.

In an embodiment, the FTC may be configured upon detonation to form either a slug or annular EFP. The slug and annular EFPs should open second holes in the inner surface that are approximately 30-40% and 60-80%, respectively, of the diameter of the undetonated precursor charge. The slug EFP opens a smaller hole but has greater penetration capability than the annular EFP. Both must maintain a relatively precise orientation to the inner surface, e.g., +/−25 degrees to orthogonal to the surface to remain effective.

In an embodiment, a sensor e.g., an impact, magnetic or proximity sensor, transmits a fire signal via cabling to both the precursor charge and FTC. The precursor charge is detonated to form the annular EFP that cuts the cabling to release the FTC. The fire signal is delayed at the FTC prior to initiating detonation of the FTC to allow for passage of the FTC through the hole formed by the precursor charge. Alternately, a separate impact, magnetic or proximity sensor could be positioned on the FTC itself.

These and other features and advantages of the disclosure will be apparent to those skilled in the art from the following detailed description of preferred embodiments, taken together with the accompanying drawings, in which:

DETAILED DESCRIPTION

The present disclosure provides a tandem charge for prosecution of underwater targets such as double-hulled sea going vessels including surface ships and submarines or in fracking operations to remove oil and gas from the Earth. The tandem charge may be specifically configured to open larger holes in the inner surface of the target than a standard shape-charge jet to increase the flow rate of water through those holes to for example, disrupt operations within the double-hulled vessel or to better remove oil or gas from the ground. Alternately, the tandem charge may be configured to disrupt operations on the other side of the outer surface of the target.

Figure 1:
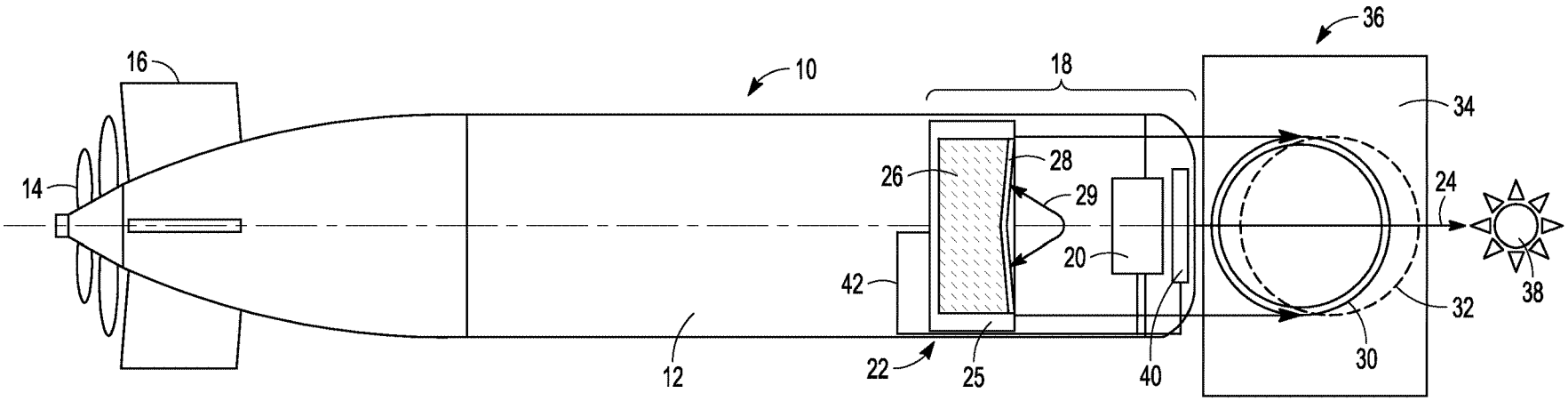
FIG. 1 is a diagram of a torpedo provided with a tandem charge in accordance with the present disclosure.

Referring now to FIG. 1, an embodiment of a self-propelled under water vehicle or "torpedo" 10 includes a casing 12, a propulsion system that drives a propeller 14 to propel the torpedo through the water, a control actuation system (CAS) that controls control surfaces 16 to steer the torpedo, and a tandem charge 18 positioned in the fore section of casing 12.

Tandem charge 18 a follow through charge (FTC) 20 positioned in front of a precursor charge (PC) 22 along a longitudinal axis 24 of charge casing 25. PC 22 includes an explosive charge 26 and a metal liner 28. Metal liner 28 is positioned on a forward surface of explosive charge 26 and configured with an apex angle 29, typically 150°-170°, such that upon detonation of explosive charge 26 the detonation wave propagates forward along axis 24 causing liner 28 to fold, forwards or backwards, to form a coherent annular EFP 30 that is projected along longitudinal axis 24 and passes around FTC 20 to cut a first hole 32 in an outer surface 34 of a target 36 such as a surface vessel or submarine. FTC 20 is configured to pass through the first hole 32 in the outer surface 34 of the target 36 for detonation 38 on the other side of the outer surface of the target. The formation of the first hole 32 in the outer surface 34 causes water to flow rapidly through the first hole 32 and carrier FTC 20 through the first hole 32 to the other side. Detonation 38 of the FTC may form a second hole in an inner surface of the target or may be used to degrade critical systems behind the outer surface. Annular EFP 30 is effectively exhausted by cutting first hole 32 and retains little capability to penetrate and form a second hole in another surface.

To effectively prosecute underwater targets, and specifically to form large holes in multiple surfaces of the targets such as is found in double-hulled ships and submarines, the positioning of FTC 20 in front of the PC 22 is critical. Upon detonation of PC 22, FTC 20 is released and allowed to be carried by the flow of water through the hole in the outer surface. In underwater applications, the FTC 20 does not have sufficient kinetic energy to force its way through or to expand first hole 32 in outer surface 34 of the target. FTC 20 needs to flow cleanly through first hole 32 with the onrushing water. Positioning FTC 20 in front of the PC 22 far forward in casing 25 accomplishes this.

A sensor and electronics package 40 is suitably positioned in the nose of the torpedo. The package may include an impact, magnetic or proximity sensor that triggers a fire signal to initiate detonation. In this example, the fire signal is carried via cabling 42 to the aft end of PC 22 and to FTC 20. The fire signal initiates detonation of PC 22 to form annular EFP 30 that cuts the cabling 42 to release FTC 20. The fire signal is delayed at the FTC prior to initiating detonation of the FTC to allow for passage of the FTC through the first hole 32 formed by the precursor charge. Alternately, a separate impact, magnetic or proximity sensor could be positioned on the FTC 20 itself.

Figure 2B:
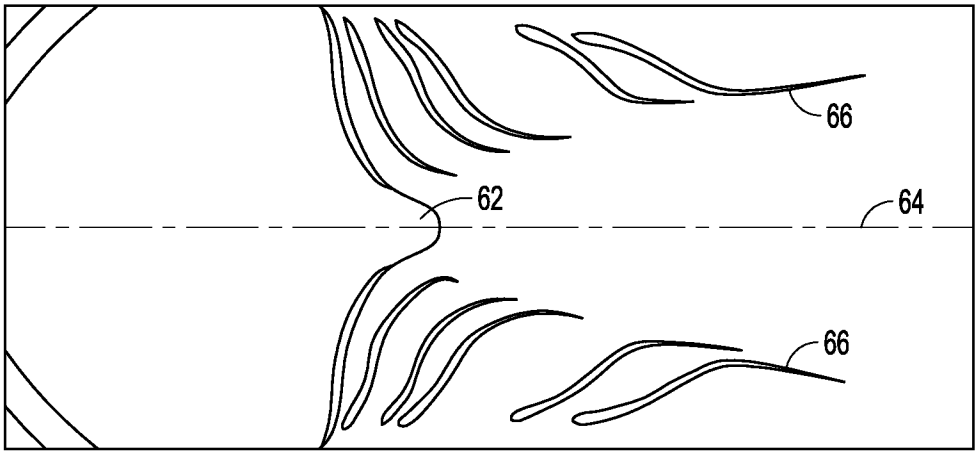
FIGS. 2A and 2B are a diagram of a first embodiment of the precursor charge and detonation thereof to form an annular EFP.
Figure 2A:
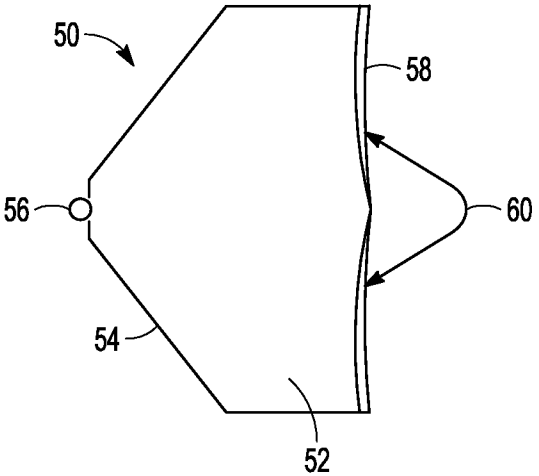

Referring now to FIGS. 2A and 2B, an embodiment of a precursor charge 50 includes a cylindrical explosive charge 52 that tapers in the shape of a "boattail" within charge casing 54 to a single point of ignition 56. In terms of performance, this is equivalent to a cylindrical explosive charge with a single point of ignition on its aft surface. The boattail configuration eliminates explosive material that does not contribute to the overall performance of the precursor charge. A metal liner 58 is formed on a forward surface of explosive charge 52 with an apex angle 60, typically 150°-170°. Upon detonation of explosive charge 52, a detonation wave 62 propagates forward and interacts with liner 58 causing the liner material to fold backward toward centerline 64 to form a coherent annular EFP 66. Depending upon the configuration of the liner 58, the diameter of the coherent annular EFP 66 at the point where it reaches the target can be between 100% and 140% of the diameter of explosive charge 52. This design has the advantage of a single point initiation but requires routing of the cabling around the precursor charge to the single point of initiation.

Figure 3A:
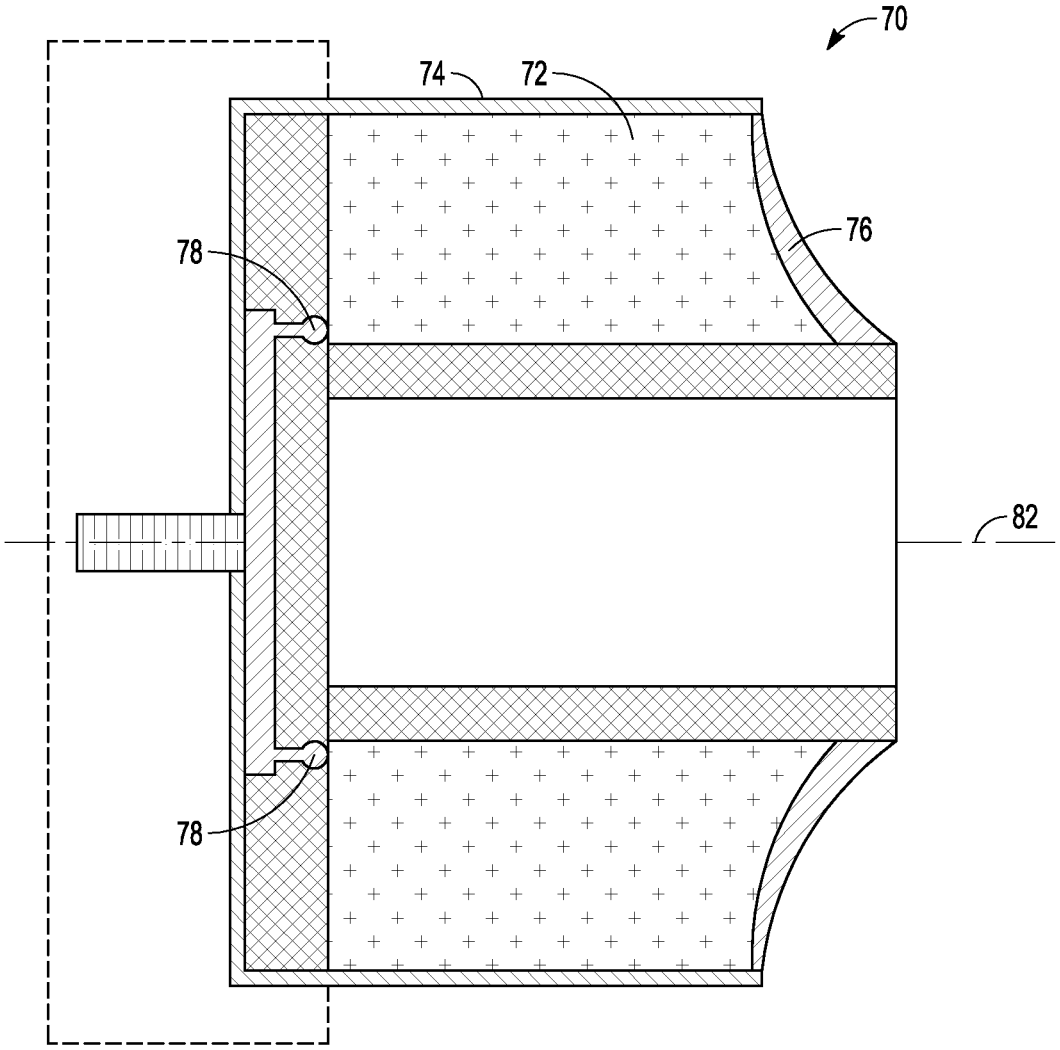
FIGS. 3A and 3B are a diagram of a second embodiment of the precursor charge and detonation thereof to form an annular EFP.
Figure 3B:
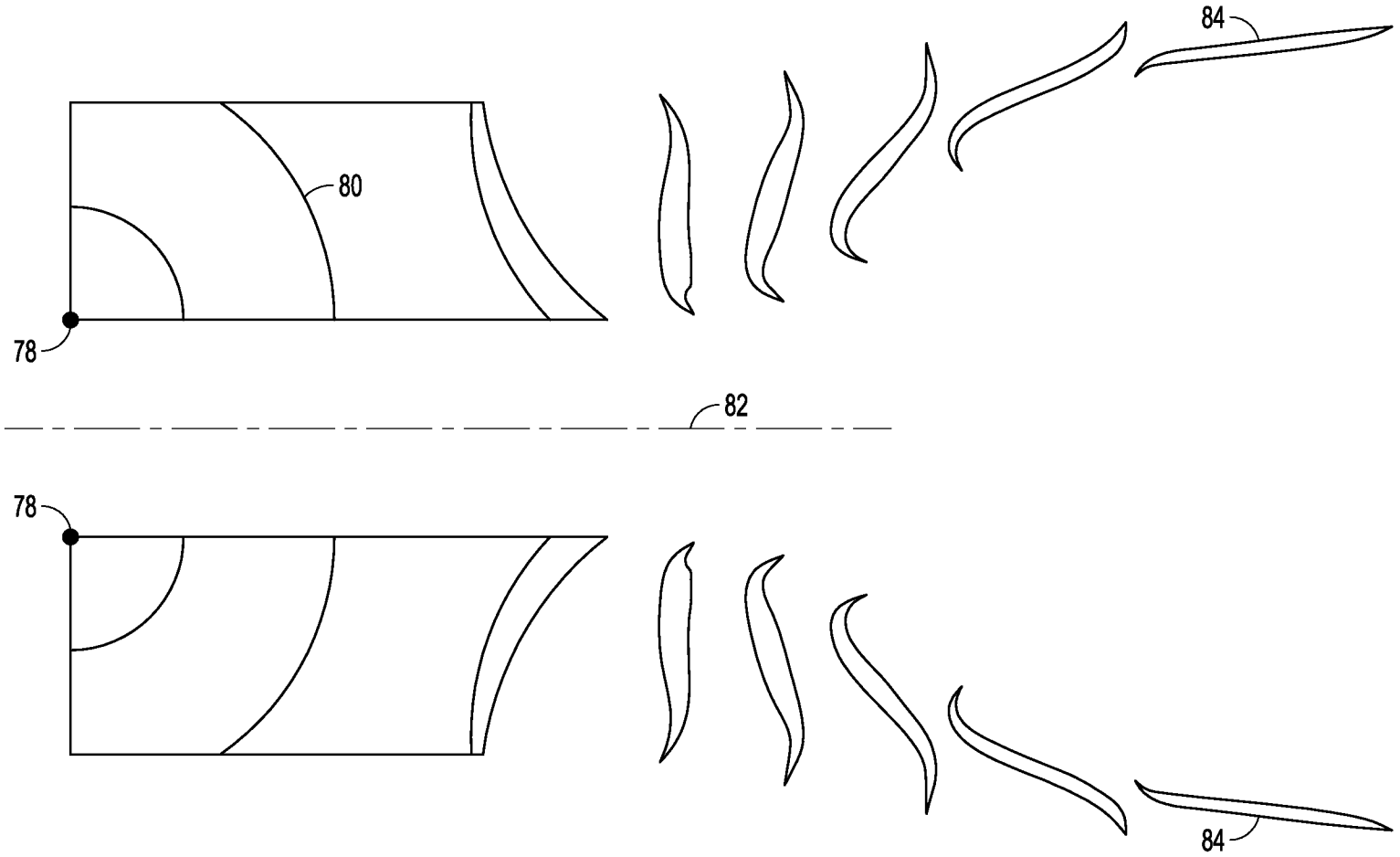

Referring now to FIGS. 3A and 3B, an embodiment of a precursor charge 70 includes an annular explosive charge 72 within charge casing 74 with an annular metal liner 76 formed on a forward surface of the charge. The apex angle is still 150°-170°. However, because of the annular shape of the charge, the apex angle is measured by the angle at which the liner opens to the void volume of the charge, from one point longitudinally along the liner to another identical point longitudinally along the liner. To initiate detonation of explosive charge 72 requires a ring initiation 78 positioned aft and at the inner wall of the charge is required. Upon detonation of explosive charge 72, a detonation wave 80 propagates forward and interacts with liner 76 causing the liner material to fold forward toward centerline 82 to form a coherent annular EFP 84. Depending upon the configuration of the liner 76, the diameter of the coherent annular EFP 84 at the point where it reaches the target can be between 100% and 140% of the diameter of explosive charge 72. This design has the advantage that it may be more mass efficient than either the cylindrical or boattail designs and that the cabling can be run along the centerline to the aft ring initiation but requires ring initiation instead of single point initiation.

Figure 4B:
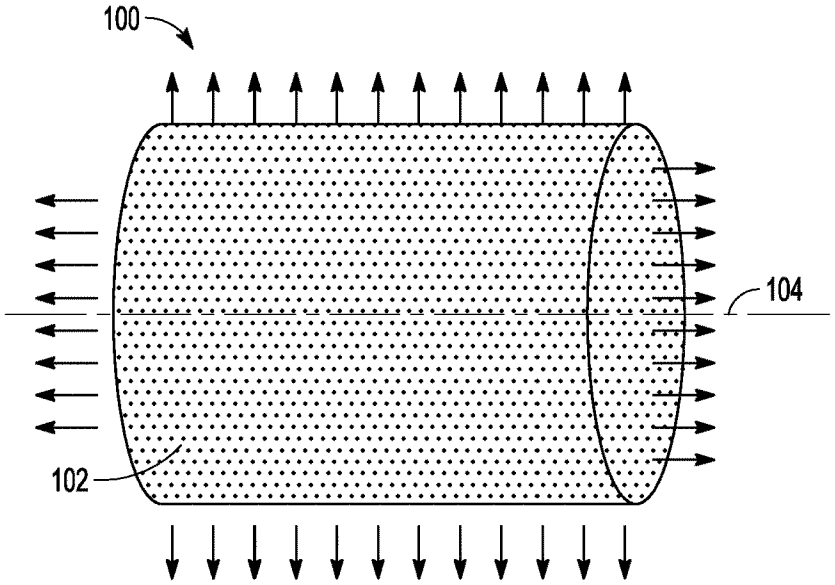
FIGS. 4A and 4B are a diagram of a blast charge configuration for the follow through charge (FTC) and the omnidirectional detonation thereof.
Figure 4A:
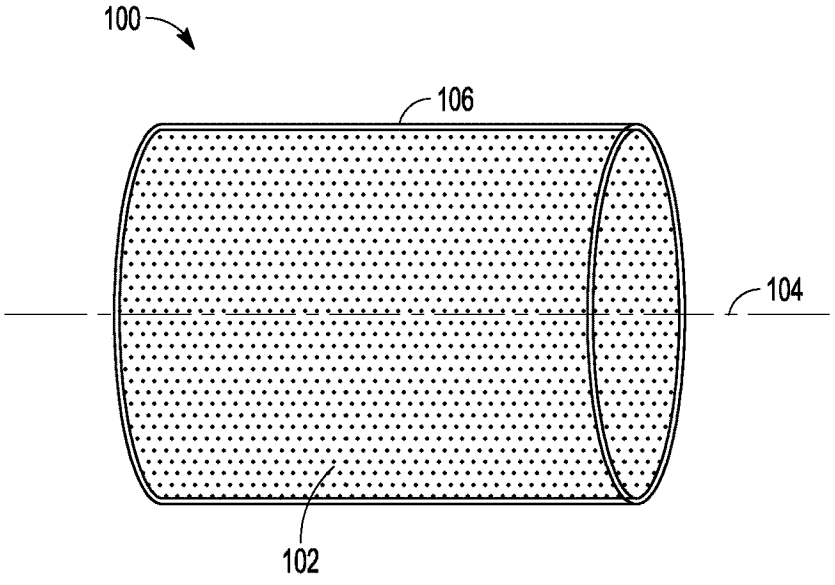

Referring now to FIGS. 4A-4B, in an embodiment, a FTC 100 may be a blast charge 102 that upon detonation expands both along the axis 104 and radially from the axis 102. The blast charge may or may not include a fragmentation casing 106. This may be referred to as an "omnidirectional" detonation. Omnidirectional detonation has the advantage of not requiring the FTC to maintain a precise orientation with respect to the inner surface of the target. The blast charge should open a second hole in the inner surface that is approximately 40-60% of the diameter of the undetonated precursor charger.

Figure 5B:
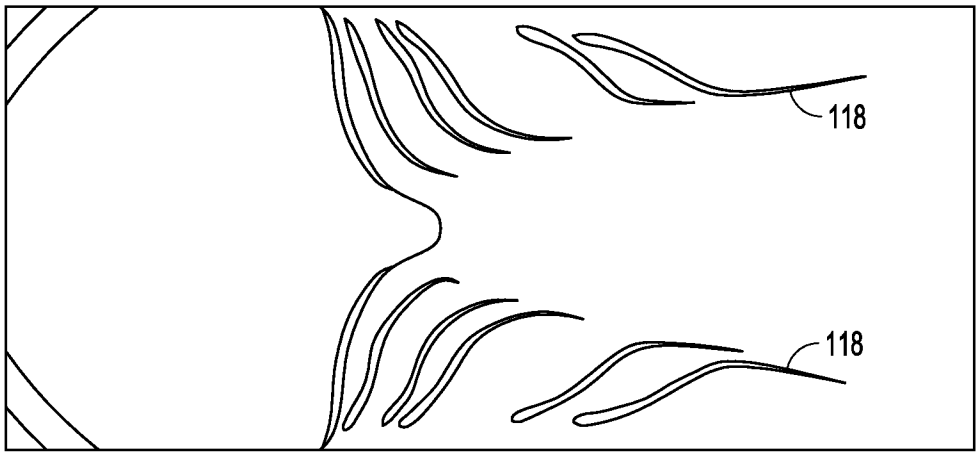
FIGS. 5A and 5B are a diagram of an annular EFP configuration for the FTC and the formation thereof.
Figure 5A:
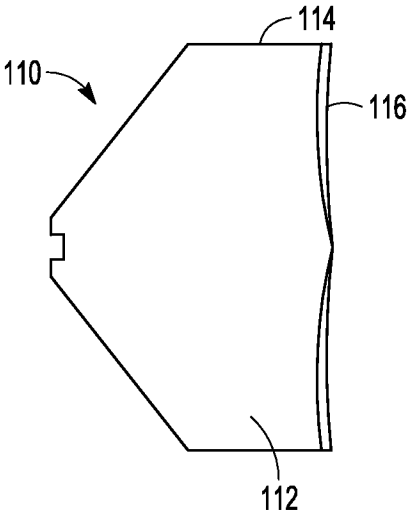

Referring now to FIGS. 5A-5B, in an embodiment, a FTC 110 may be configured upon detonation to form either a slug or annular EFP. The slug and annular EFPs should open second holes in the inner surface that are approximately 30-40% and 60-80%, respectively, of the diameter of the undetonated precursor charge. The slug EFP opens a smaller hole but has greater penetration capability than the annular EFP. Both must maintain a relatively precise orientation to the inner surface, e.g., +/−25 degrees to perpendicular to the surface to remain effective. In this example, FTC 110 includes an explosive charge 112 within a charge casing 114 in a boattail configuration with a single point initiation. A metal liner 116 is formed on a forward surface of explosive charge 112. Upon detonation, the metal liner folds backward toward the centerline to form a coherent annular EFP 118.

Figure 6A:
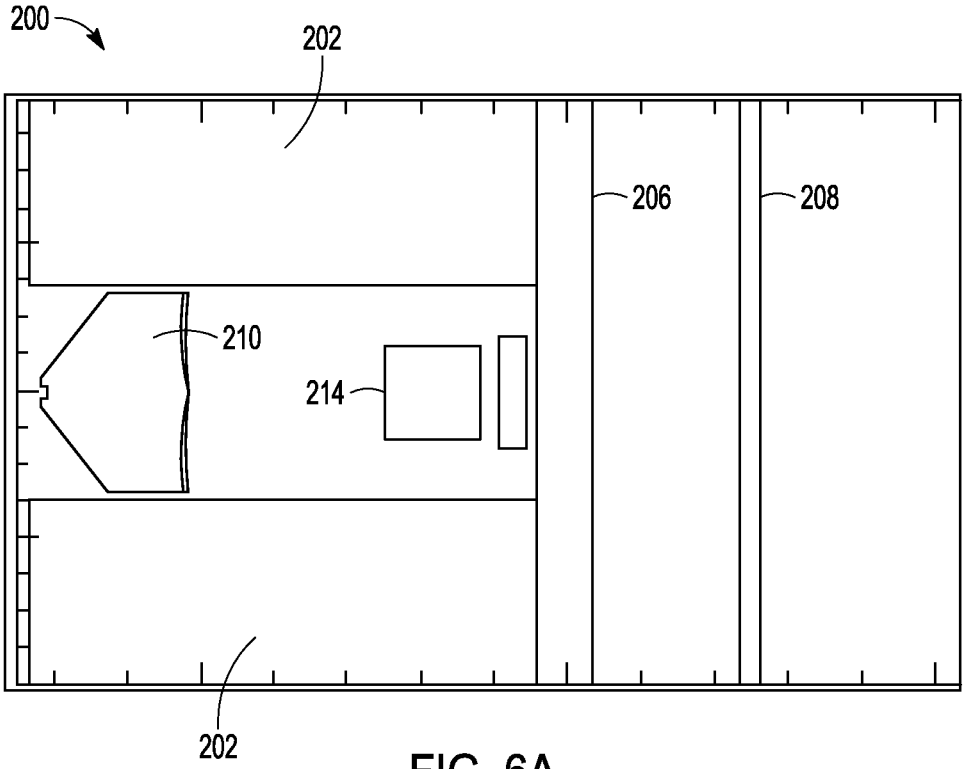
FIGS. 6A-6H illustrate a detonation sequence of the precursor charge and FTC to open holes in outer and inner surfaces of a target.
Figure 6B:
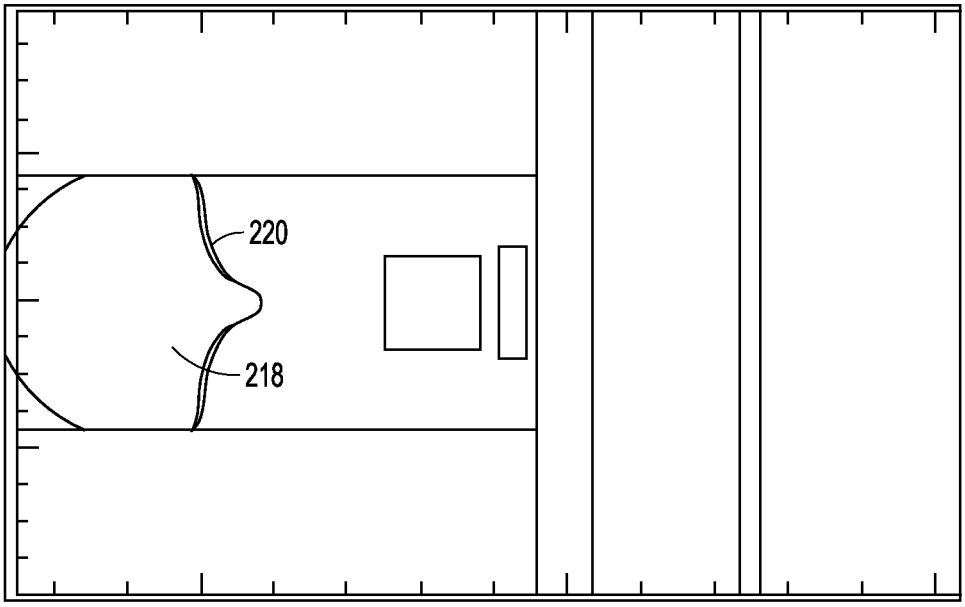
Figure 6C:
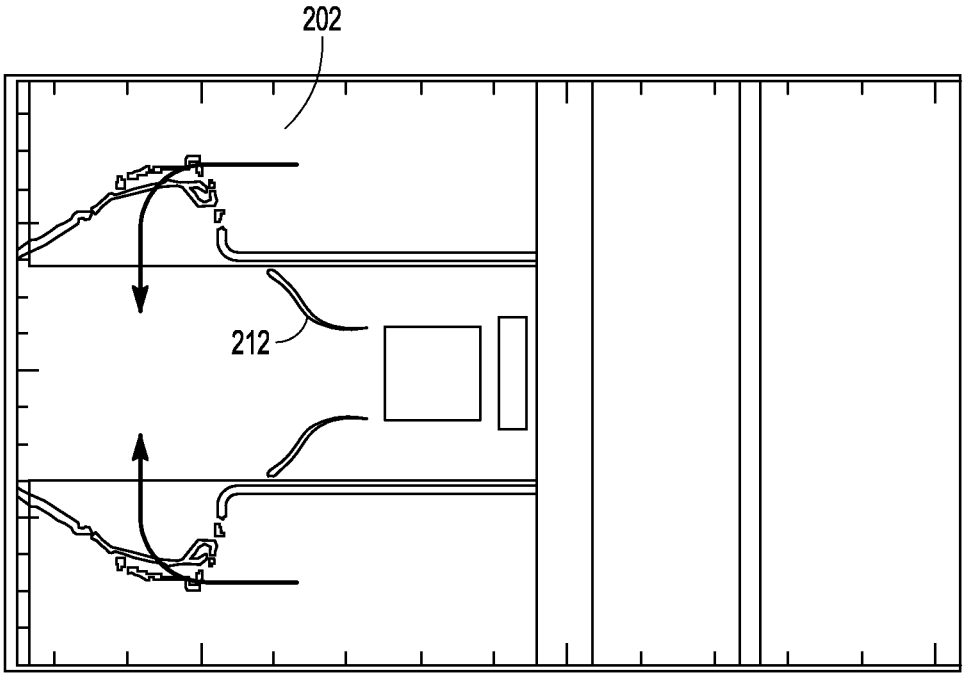
Figure 6D:
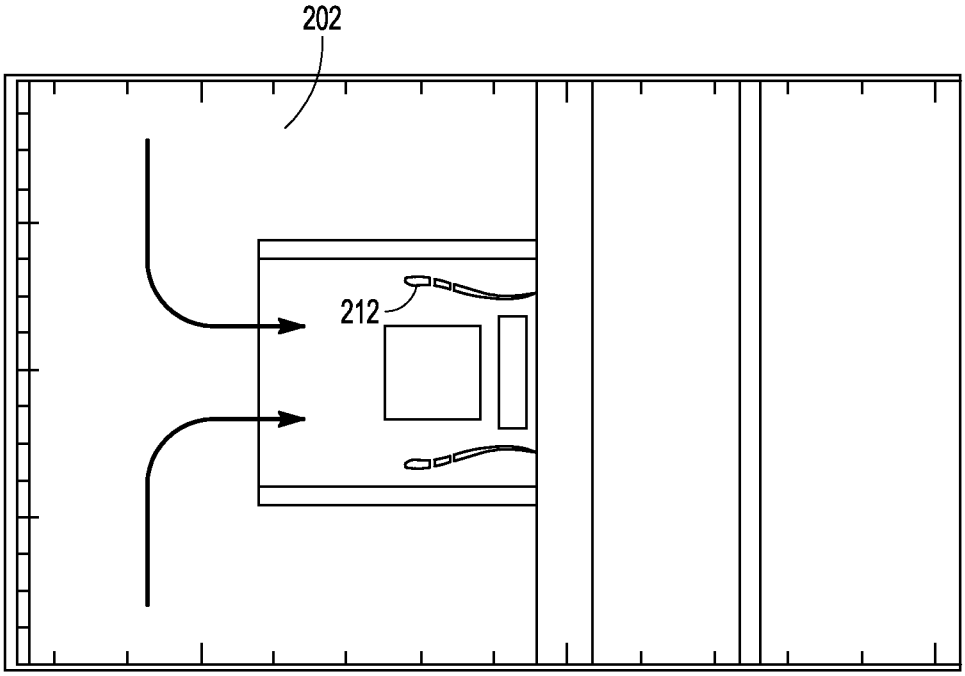
Figure 6E:
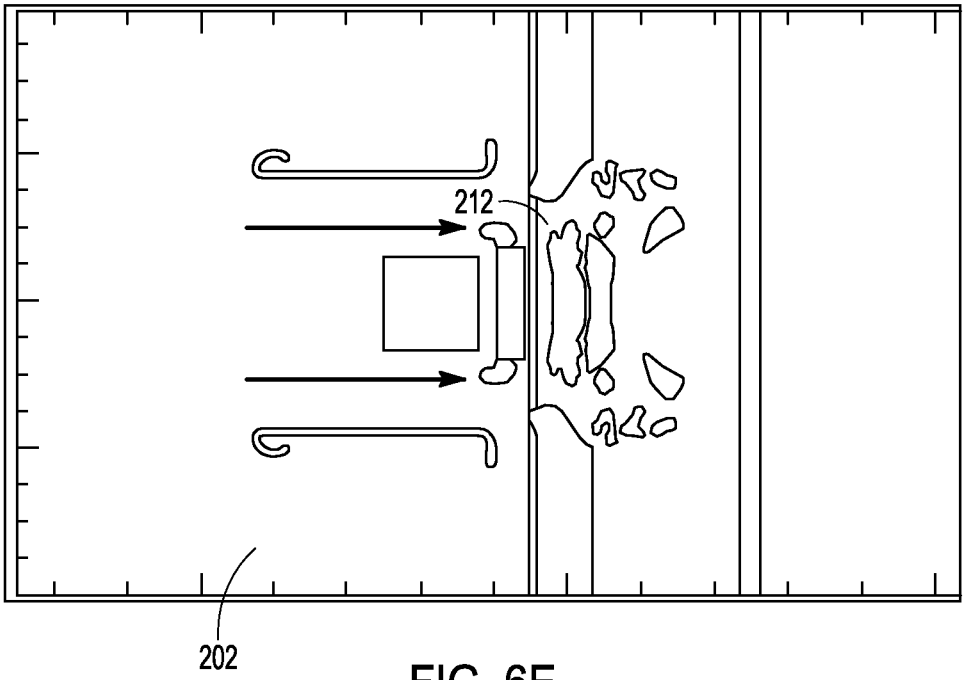
Figure 6F:
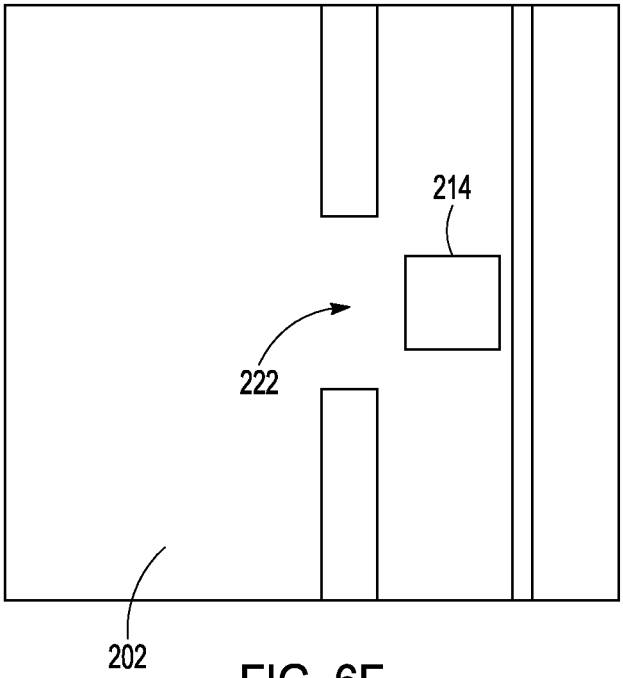
Figure 6G:
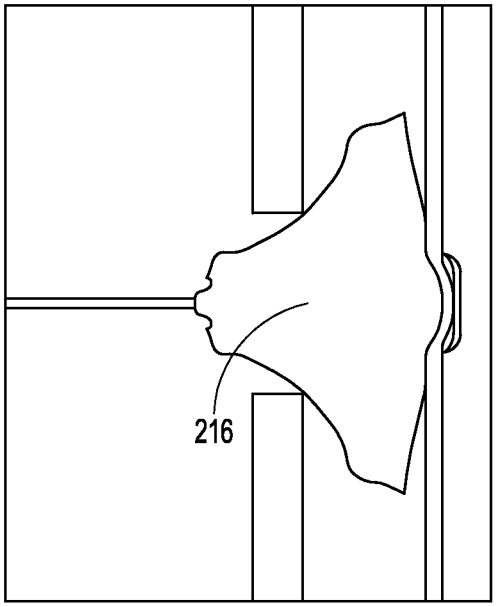
Figure 6H:
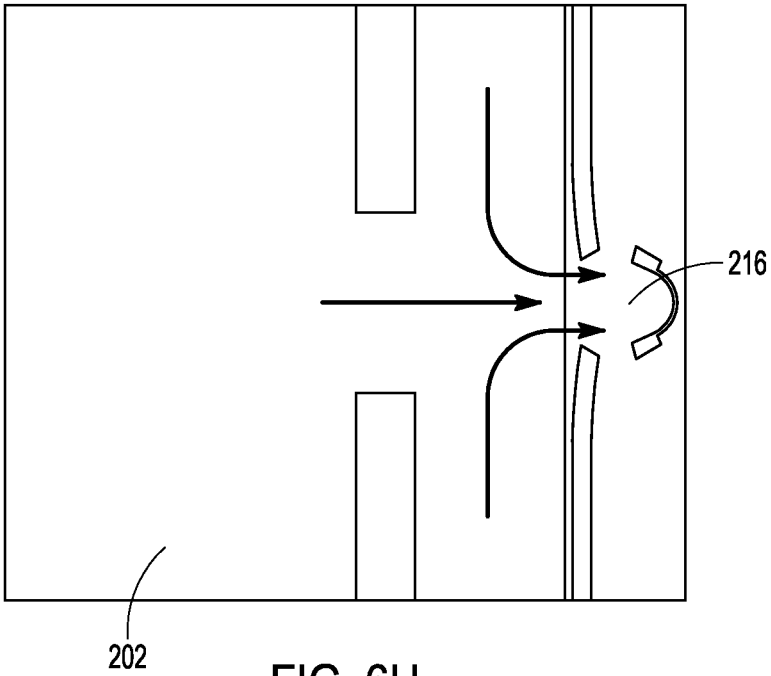
Figure 7A:
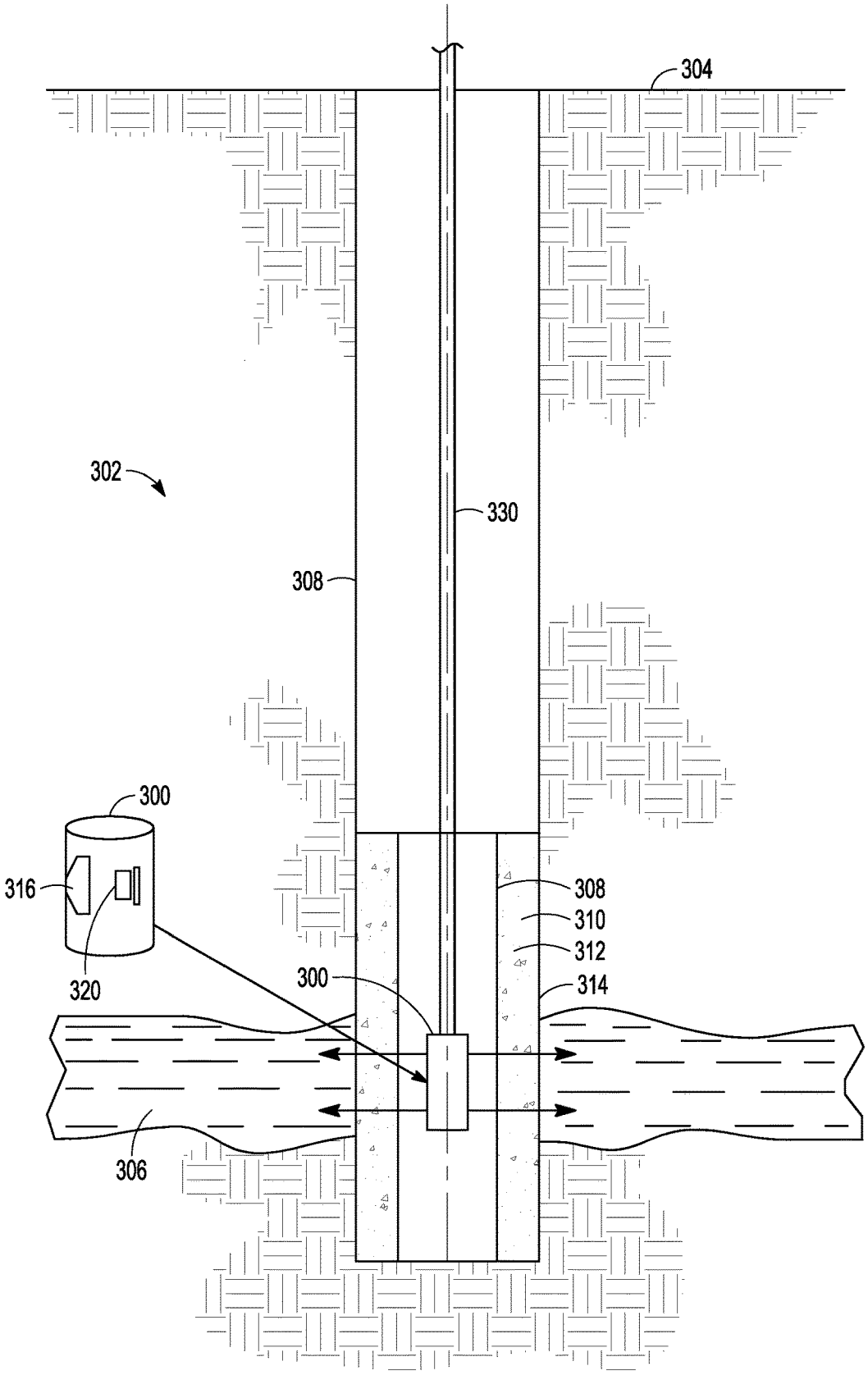
FIGS. 7A-7E illustrate a detonation sequence of the precursor charge and FTC as applied to oil and gas drilling or fracking.
Figure 7B:
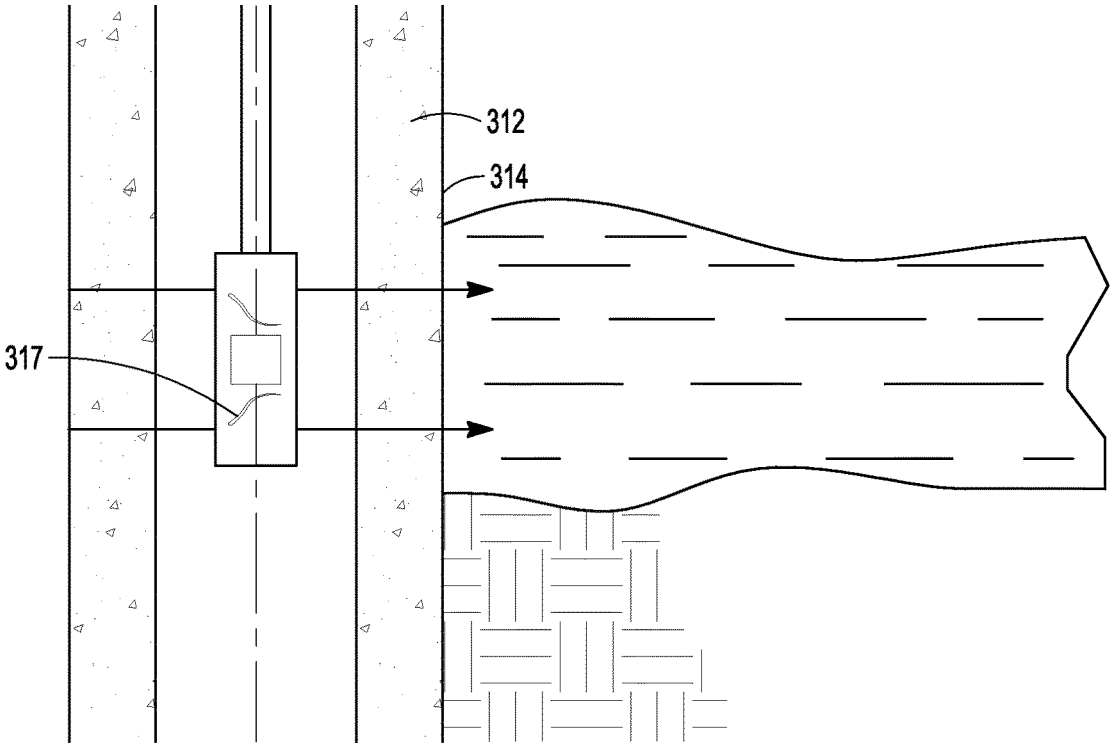
Figure 7C:
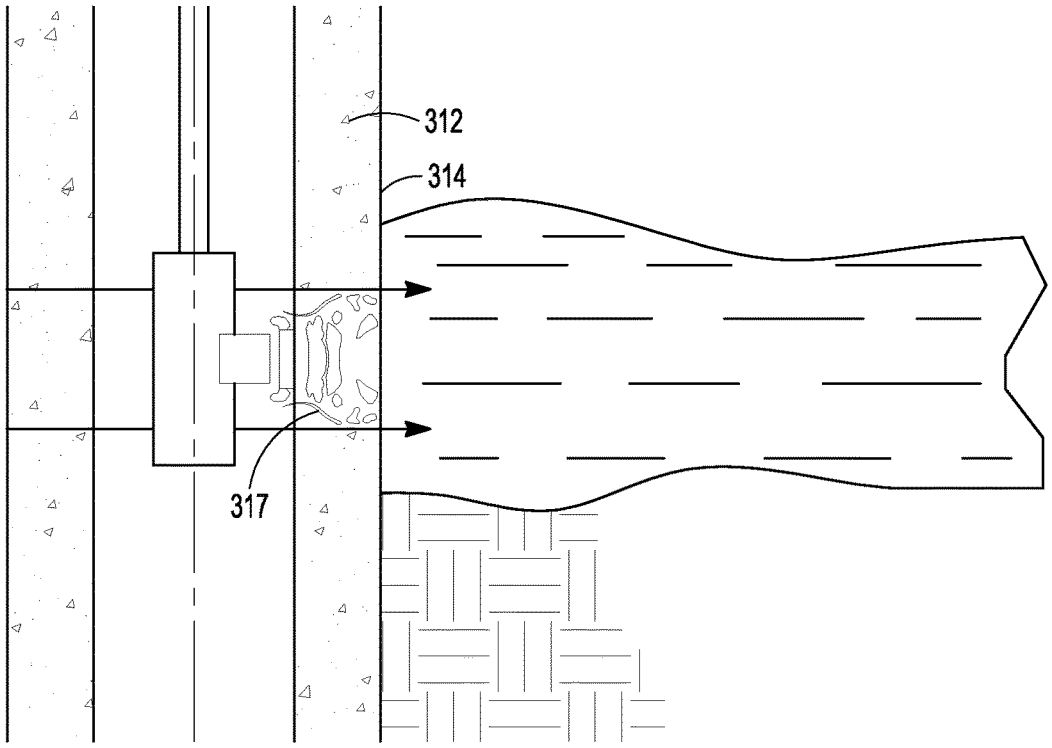
Figure 7D:
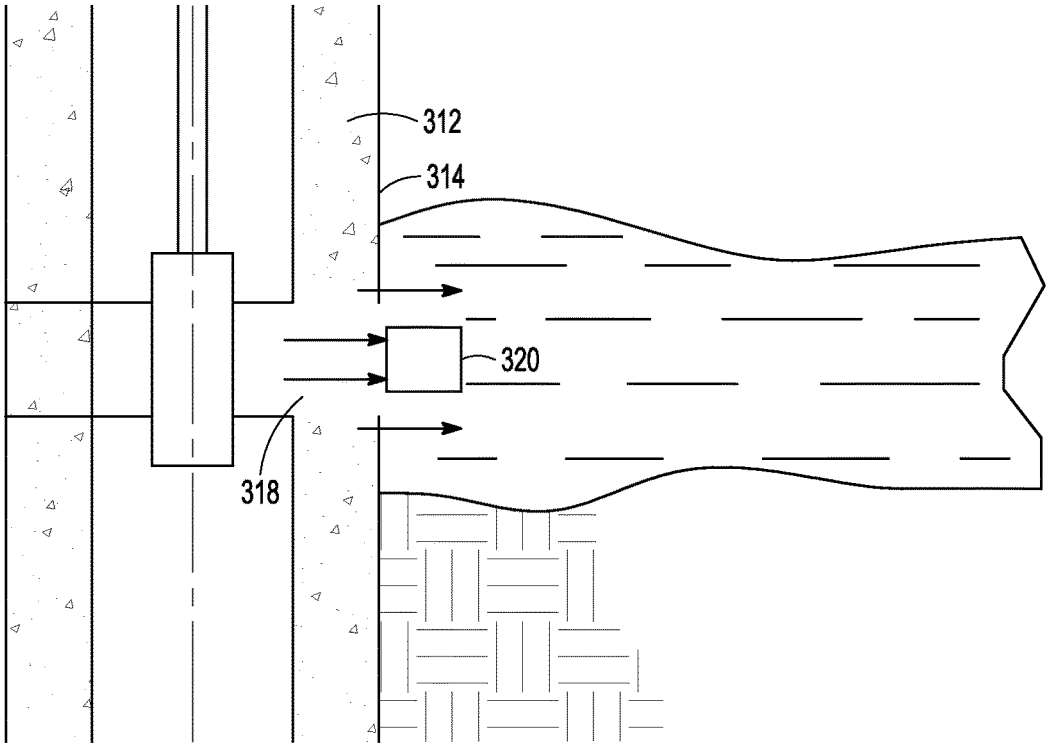
Figure 7E:
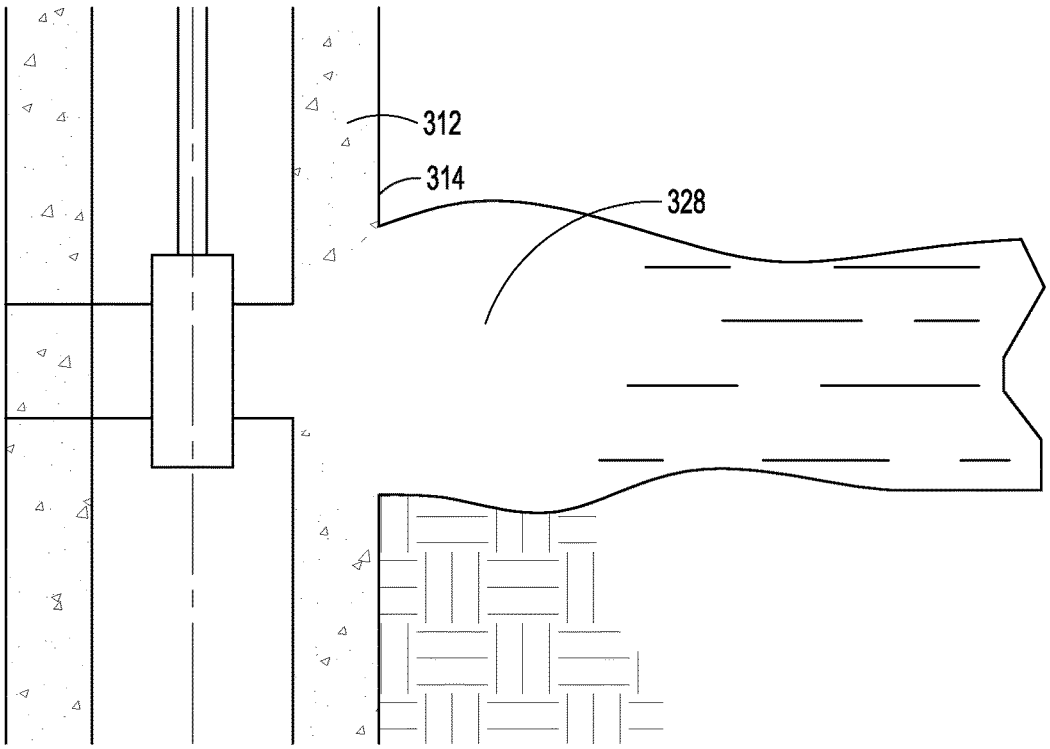

Referring now to FIGS. 6A-6H, a torpedo is outfitted with a tandem charge 200 and self-propelled under water 202 to attack a double-hulled vessel (surface ship or submarine) and form holes in the outer and inner hulls 206 and 208, respectively, of the vessel. Tandem charge 200 is provided with a precursor charge 210, which upon detonation forms a coherent annular EFP 212, and a FTC 214, which upon detonation provides an omnidirectional fragmentation pattern 216. As shown in FIG. 6B, a fire signal has initiated detonation of precursor charge 210 causing a detonation wave 218 to propagate forward along the centerline and start to deform the liner 220. As shown in FIGS. 6C-E, the liner material folds backwards toward the center line and accelerates to form coherent annular EFP 212 within the void space in the charge casing to cut a first hole 222 in outer hull 206. As the liner material folds and accelerates to form the coherent annular EFP 212, the detonation wave 218 has ruptured the aft portion of the charge casing allowing water 202 to rush into the void space and flow through the first hole 222 in the outer hull 206. Formation of EFP 212 preferably stays in front of the onrushing water. As shown in FIG. 6F, the rushing water 202 carries FTC 214 through the first hole 222 in the outer hull 206 to the inner hull 208. As shown in FIG. 6G, detonation of FTC 214 produces the omnidirectional fragmentation pattern 216 at the surface of inner hull 208. As shown in FIG. 6H, the omnidirectional fragmentation pattern 216 forms a second hole 224 in the inner hull 208. The diameter of second hole 224 being large enough to allow water to rush in and disrupt operations.

With FTC 214 configured as a blast charge, the second hole 216 in the inner hull has a diameter that is at least 50% of the diameter of the precursor charge 210. This compares to the shaped charged jets that represent the current state-of-the-art (SOA) in torpedo designs that produce a hole in the inner hull that is approximately 10% of the precursor charge. Assuming a depth of 100 m, this produces a 2,200% increase in flow rate of water through the inner hull into the surface ship or torpedo as compared to the shaped charge jet.

If the FTC 214 where configured to produce a slug EFP with a hole diameter in the inner hull of 30% of the diameter of the precursor charge, the flow rate would increase approximately 900% as compared to the shaped charge jet. If the FTC 214 were configured to produce an annular EFP with a hole diameter in the inner hull of at least 70% of the diameter of the precursor charge, the flow rate would increase approximately 4,900% as compared to the shaped charge jet.

Bottomline, a tandem charge that combines an annular EFP to open a hole in an outer hull to allow a FTC to be carried through the hole by onrushing water to the inner hull where its detonation forms a larger hole in the hull than the SOA shaped charge jet greatly enhances the capabilities of a torpedo to degrade the double-hulled structure of a surface ship or submarine and system operations therein.

As shown in FIGS. 7A-7E, a tandem charge 300 is configured and used for oil and gas drilling or fracking. A well 302 extends from a surface level 304 to a subterranean formation 104, hopefully a void space containing oil or gas and other materials. In this example, well 302 is defined by a side wall comprising a casing 308, and cement 310 is disposed around casing 308 in an annular space 312 defined between casing 308 and the wall 314 of the well bore. The well bore is filled with water. Casing 308, cement 310 and wall 314 of the well fore are collectively referred to as a side wall of the well. Tandem charge 300 is configured as a side-firing charge such that its precursor charge (PC) 316 forms an annular EFP 317 that perforates this side wall forming a hole 318 in the well casing at the depth of the hydrocarbon producing zone through which a FTC 320 is carried by water from the well bore into subterranean formation 104 where it is detonated produce a void 328 to assist in the extraction of hydrocarbons. A dashed line 330 represents a wire lead as one method for positioning and then initiating the tandem charge 300.

While several illustrative embodiments of the disclosure have been shown and described, numerous variations and alternate embodiments will occur to those skilled in the art. Such variations and alternate embodiments are contemplated, and can be made without departing from the spirit and scope of the disclosure as defined in the appended claims.

I claim:

1. A tandem charge for prosecution of an underwater target, comprising:

an underwater propulsion system;

a charge casing;

a precursor charge including an explosive charge and a liner oriented along an axis in the charge casing; and a follow through charge (FTC) oriented along the axis in front of the precursor charge in the charge casing, wherein the precursor charge is configured such that upon detonation of its explosive charge the liner forms an annular explosively formed penetrator (EFP) that is projected along the axis and passes around the FTC to cut a first hole in an outer surface of the target;

wherein the FTC is configured to pass through the first hole in the outer surface of the target for detonation on the other side of the outer surface of the target.

2. The tandem charge of claim 1, wherein the precursor charge is configured such that detonation of the explosive charge forms at least 90% of the liner into a solid ring that provides the annular EFP.

3. The tandem charge of claim 1, wherein the FTC comprises a blast charge that upon detonation expands both longitudinally along the axis and radially from the axis.

4. The tandem charge of claim 1, wherein the FTC is configured upon detonation to form a second annular EFP whose diameter is less than a diameter of the first annular EFP.

5. The tandem charge of claim 1, wherein the FTC is configured upon detonation to form a slug EFP.

6. The tandem charge of claim 1, wherein detonation of the FTC forms a second hole in an inner surface of the target.

7. The tandem charge of claim 6, wherein a diameter of the second hole is at least 30% of a diameter of the precursor charge prior to detonation.

8. The tandem charge of claim 1, wherein the FTC is configured to be pulled through the first hole in the outer surface by the flow of water through the first hole without additional propulsion.

9. The tandem charge of claim 1, wherein the precursor charge includes at least 70% and the FTC includes at most 30% of a total explosive mass.

10. The tandem charge of claim 1, wherein detonation of the precursor charge forms only the annular EFP.

11. The tandem charge of claim 1, wherein a fire signal is received by both the precursor charge and the FTC, said fire signal being delayed at the FTC prior to initiating detonation of the FTC to allow for passage of the FTC through the hole created by the precursor charge.

12. A tandem charge, comprising:

a charge casing;

a precursor charge including an explosive charge and a liner oriented along an axis in the charge casing; and a follow through charge (FTC) oriented along the axis in front of the precursor charge within the charge casing, wherein the precursor charge is configured such that upon detonation of the explosive charge the liner forms an annular explosively formed penetrator (EFP) that is projected along the axis and passes around the FTC;

wherein the FTC is configured to follow the EFP along the axis for subsequent detonation.

13. The tandem charge of claim 12, wherein the FTC comprises a blast charge, an annular EFP or a slug EFP.

14. The tandem charge of claim 12, wherein the annular EFP forms a hole in a target, wherein the FTC is configured to be pulled through the hole in the target by the flow of water through the hole without additional propulsion.

15. The tandem charge of claim 14, wherein a fire signal is received by both the precursor charge and the FTC, said fire signal being delayed at the FTC prior to initiating detonation of the FTC to allow for passage of the FTC through the hole created by the precursor charge.

16. A method for prosecution of an underwater target, comprising:

directing a tandem charge at the underwater target, said tandem charge including a precursor charge including an explosive charge and a liner oriented along an axis and a follow through charge (FTC) positioned on the axis in front of the precursor charge;

detonating the explosive charge such that the liner forms an annular explosively formed penetrator (EFP) that is projected along the axis and passes around the FTC to cut a first hole in an outer surface of the target allowing water to flow through the first hole;

allowing the flow of water to carry the FTC through the first hole in the outer surface of the target; and detonating an explosive material in the FTC on the other side of the outer surface of the target.

17. The method of claim 16, wherein FTC comprises a blast charge, an annular EFP or a slug EFP.

18. The method of claim 16, wherein detonation of the FTC forms a second hole in an inner surface of the target.

19. The method of claim 18, wherein a diameter of the second hole is at least 30% of a diameter of the undetonated precursor charge.

20. The method of claim 18, wherein the target is a sea going vessel having a double-hull that provides the outer and inner surfaces.

* * * * *